US005112057A

United States Patent [19]

Popovic

[11] Patent Number: 5,112,057

[45] Date of Patent: May 12, 1992

[54] APPARATUS FOR PLAYING A GAME

[76] Inventor: Nenad Popovic, 99 Station Street, Cheslyn Hay, Nr. Walsall, West Midlands, United Kingdom

[21] Appl. No.: 603,637

[22] Filed: Oct. 25, 1990

[30] Foreign Application Priority Data

Oct. 26, 1989 [GB] United Kingdom ..... 8924169

[51] Int. Cl.[5] ..... A63F 3/00; A63F 9/18

[52] U.S. Cl. ..... 273/243; 273/144 B; 273/430; 273/432; 273/148 R

[58] Field of Search ..... 273/243, 249, 157 R, 273/153 R, 236; 434/348

[56] References Cited

U.S. PATENT DOCUMENTS

| | | | |
|---|---|---|---|
| 1,359,646 | 11/1920 | Zion | 434/322 |
| 4,053,154 | 10/1977 | Niemann | 273/243 |
| 4,315,627 | 2/1982 | Schlegel et al. | 273/249 |
| 4,403,775 | 9/1983 | Chaput | 273/144 B |
| 4,566,698 | 1/1986 | Sueden | 273/249 |
| 4,679,796 | 7/1987 | Rein | 273/236 |

FOREIGN PATENT DOCUMENTS

| | | | |
|---|---|---|---|
| 2633192 | 12/1989 | France | 273/256 |
| 586817 | 4/1947 | United Kingdom | 273/249 |
| 2060410 | 5/1981 | United Kingdom | 273/249 |
| 2112989 | 7/1983 | United Kingdom | 273/249 |

*Primary Examiner*—Benjamin Layno

*Attorney, Agent, or Firm*—Kirschstein, Ottinger, Israel & Schiffmiller

[57] ABSTRACT

Apparatus for playing a game comprises clue means (C) for progressively revealing a clue as to a mystery entity to players in the course of the game. The clue means (C) is provided with a plurality of mask segments which, initially at least substantially conceal the clue but which, in the course of the game may be removed (or the like) so as progressivley to reveal the clue. A selection of information carrying articles are collected by the players in the course of the game, and are such that, for a given mystery article, there is an element of chance as to whether a particular information carrying entity will relate correctly to the mystery entity uncovered.

12 Claims, 5 Drawing Sheets

| | | | | | | | | | | |
|---|---|---|---|---|---|---|---|---|---|---|
| LINE 1 | PASS DICE TO WHITE | ANSWER Q1 (1 FLID) | LOSE TURN | THROW 3 OR LESS (1 FLID) | GREEN BASE | ANSWER Q6 (1 FLID) | THROW 6 (3 FLIDS) | STAR ** SEARCH | THROW AGAIN | • |
| LINE 2 | THROW 4 OR MORE (1 FLID) | PASS DICE TO BLUE | ANSWER Q2 (1 FLID) | LOSE TURN | RED BASE | THROW AGAIN | ANSWER Q5 (1FLID) | THROW 2 OR LESS (2 FLIDS) | TAKE A LIFAX (RED) | • • • • • • |
| LINE 3 | LOSE ALL FLIDS | THROW 5 OR MORE (2 FLIDS) | PASS DICE TO BROWN | ANSWER Q3 (1 FLID) | YELLOW BASE | STAR ** SEARCH | THROW AGAIN | ANSWER Q4 (1 FLID) | THROW 3 OR LESS (1 FLID) | • • • • |
| LINE4 | THROW AGAIN | TAKE A GENIFAX (BLUE) | ANSWER Q4 (1 FLID) | THROW 1 (3 FLIDS) | WHITE BASE | PASS DICE TO GREEN | LOSE TURN | THROW 4 OR MORE (1 FLID) | ANSWER Q1 (1 FLID) | • • |
| LINE 5 | STAR ** SEARCH | ANSWER Q5 (1 FLID) | THROW 3 OR LESS (1FLID) | THROW AGAIN | BLUE BASE | THROW 5 OR MORE (2 FLIDS) | PASS DICE TO RED | ANSWER Q3 (1 FLID) | LOSE TURN | • • • • • |
| LINE 6 | ANSWER Q6 | THROW2 OR LESS (2 FLIDS) | THROW AGAIN | TAKE A NAT FAX (WHITE) | BROWN BASE | LOSE ALL FLIDS | ANSWER Q2 (1FLID) | PASS DICE TO YELLOW | THROW 4 OR MORE (1FLID ) | • • • |

FIG. 4

FIG. 5b
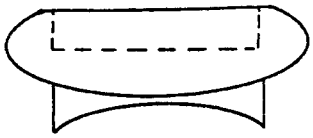
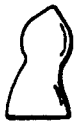
FIG. 5c
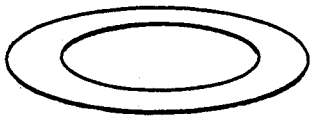
FIG. 5a
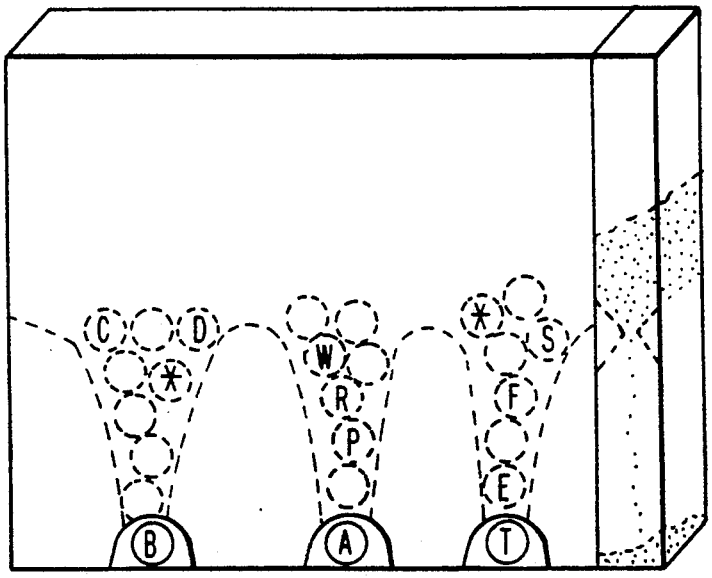
FIG. 6

APPARATUS FOR PLAYING A GAME

BACKGROUND OF THE INVENTION

This invention relates to apparatus for playing a game.

SUMMARY OF THE INVENTION

The invention provides apparatus for playing a mystery entity identification game, the apparatus comprising a plurality of clue providing means relating to a plurality of mystery entities, each of the clue providing means providing a clue as to a specific mystery entity to which that particular clue providing means relates, initial selection of such clue providing means being effective to determine the mystery entity to be identified, and the apparatus being such that the clue provided by that clue providing means may be progressively revealed in the course of the game.

The apparatus may further comprise clue means into which any selected such clue providing means may be incorporated, the clue means being adapted to permit the clue provided by that clue providing means to be progressively revealed in the course of the game.

The apparatus may further comprise a selection of information carrying articles to be collected by players in the course of the game for later comparison with the pre-determined mystery entity when the latter has been identified, each such article specifying one of a number of possible characteristics which individual mystery entities may have.

Thus the invention provides apparatus for playing a game, comprising clue means for progressively revealing a clue as to a mystery entity to players in the course of the game, and a selection of information-carrying articles to be collected by the players in the course of the game.

Preferably the selection of information-carrying articles is such that, for a given mystery entity, there is an element of chance as to whether a particular information-carrying article will correctly relate to the mystery entity concerned.

Thus, for example, at some point in the course of play the clue will have been revealed sufficiently for one, some or all of the players to identify, or provide other information on, the mystery entity, at which point due account may be taken of the number of information-carrying articles, collected by the individual players, which correctly relate to the mystery entity concerned.

The apparatus may comprise a plurality of tokens.

The game may for example be a multi-round game the object of each round of which is to identify, or provide other relevant information on, a respective different mystery entity [for example a person, an object or a place] and said tokens may be awarded to winners of individual rounds, for use in determining the winner and/or time of completion of the game as a whole.

Preferably the clue means is provided with a plurality of mask segments which, initially, at least substantially conceal the clue but which, in the course of the game, may be removed [or the like] so as progressively to reveal the clue.

The apparatus may comprise, from the outset, a plurality, preferably a substantial number, of such clues each of which may be incorporated, usually individually into, the clue means, to enable a substantial number of rounds or games to be completed without a repeat of a particular mystery entity, but alternatively or additionally the clue means may permit clues provided by items such as photographs, illustrations, text or other cuttings from printed publications such as newspapers or magazines to be incorporated into the clue means if desired, leading to virtually limitless possibilities with regard to the mystery entity.

Said segments of the clue means may be removed, for example, at intervals, in accordance with the "turns" taken by the players and/or in accordance with the outcome of those turns.

Said tokens to be awarded may be afforded by a plurality of sets of tokens of different types.

One of said tokens, for example selected at random, may be awarded to whichever player wins a round. The winner of the game may be that player who, over a number of said rounds, is the first to collect a predetermined number of selection or said tokens, such as in accordance with rules of the game.

Preferably the apparatus comprises random outcome means, for example a die or dice.

Thus, for example, the players may take "turns" following an agreed order, and the random outcome means may be used by the players at their respective turns to determine the outcome of said turns, for example whether a player is entitled to be awarded one or more of said information-carrying articles.

Advantageously the apparatus comprises a board and a plurality of playing pieces to be moved from position to position on the board by the respective players, in the course of the game. Preferably positions having different characteristics are provided e.g. being of different colours for specifying or determining different outcomes.

Thus, for example, the random outcome means may be utilised for determining the extent of each such move, and the outcome of a "turn" may be determined by the playing position at which a respective playing piece "lands".

Preferably the apparatus comprises counters ["flids"] to be awarded to the players in the course of the game.

In determining the winner of each round, points represented, inter alia, by said counters may be taken into account.

Points may be awarded for answering a question [e.g. on a card drawn at random from a pack of question cards] correctly, or for a particular outcome or outcomes of the random outcome means, or in accordance with the number and nature of information-carrying articles which, when the mystery entity has been identified or the like, are found correctly to relate to the mystery entity. The apparatus may comprise further components and elements enabling players to gain points in other ways in the course of the game.

Thus for example the apparatus may further comprise a device adapted to provide a randomly generated question or clue, and, advantageously, having built-in timing means to determine the time interval allowed for a player to provide a correct answer.

The clue or question may be provided by a number of clue-providing elements adapted to move at random to positions at which they dictate the question or clue.

Thus the invention provides a device comprises a casing having therein a plurality of loose clue-providing elements, such that on shaking the device, one or more of the elements appear at a respective window or at respective windows or the like of the device from which the question or clue so dictated may be read.

Preferably said device further comprises built-in timing means, for example a "sand clock" or an electronic or mechanical timer for allocating a predetermined time interval to a player for providing a correct answer.

The apparatus may further comprise means to permit players to submit concealed answers as to the mystery entity which answers are inspected as soon as the mystery entity has actually been identified [or the like], points being awarded to the player or players whose submitted answer or answers proved to be correct.

Preferably the apparatus is adapted such as to have an astronomical or astrological character.

The invention further provides apparatus for playing a game comprising clue means adapted to progressively reveal a clue in the course of the game, the clue means being provided with a plurality of mask segments which, initially, at least substantially conceal the clue but which, in the course of the game, may be removed [or the like] so as progressively to reveal the clue.

The invention still further provides apparatus for playing a game, comprising means by which players may submit concealed answers to a question, which answers may be inspected when the question has been answered in the course of the game.

The invention also provides apparatus for playing a game, the apparatus comprising a board and a plurality of playing pieces to be moved from position to position on the board in the course of playing the game, the apparatus further comprising a plurality of counters ["flids"] or the like to be collected by the players in the course of the game, and the playing pieces being adapted to be capable of accommodating the counters accumulated by the respective players in the course of the game.

Any of the above described apparatus may be provided in the form of permanent physical objects, or in computerised form for display on a screen or the like, and may for example provide the game in a domestic/-club environment and/or in a format suitable for a television "game show" or the like.

One embodiment of apparatus illustrative of all the aforesaid aspects of the invention will now be described by way of example only, with reference to the accompanying drawings, in which:

BRIEF DESCRIPTION OF THE DRAWINGS

FIG. 4 illustrates schematically markings which appear around the outer edges of the board of FIG. 2;

FIG. 5A illustrates a playing piece;

FIG. 5B illustrates an elevation view of a flid capable of being accommodated in the playing piece;

FIG. 5C illustrates a perspective view of flid; and

FIG. 6 illustrates a question/clue generating device included in the apparatus.

DETAILED DESCRIPTION OF A PREFERRED EMBODIMENT

Figure 1:
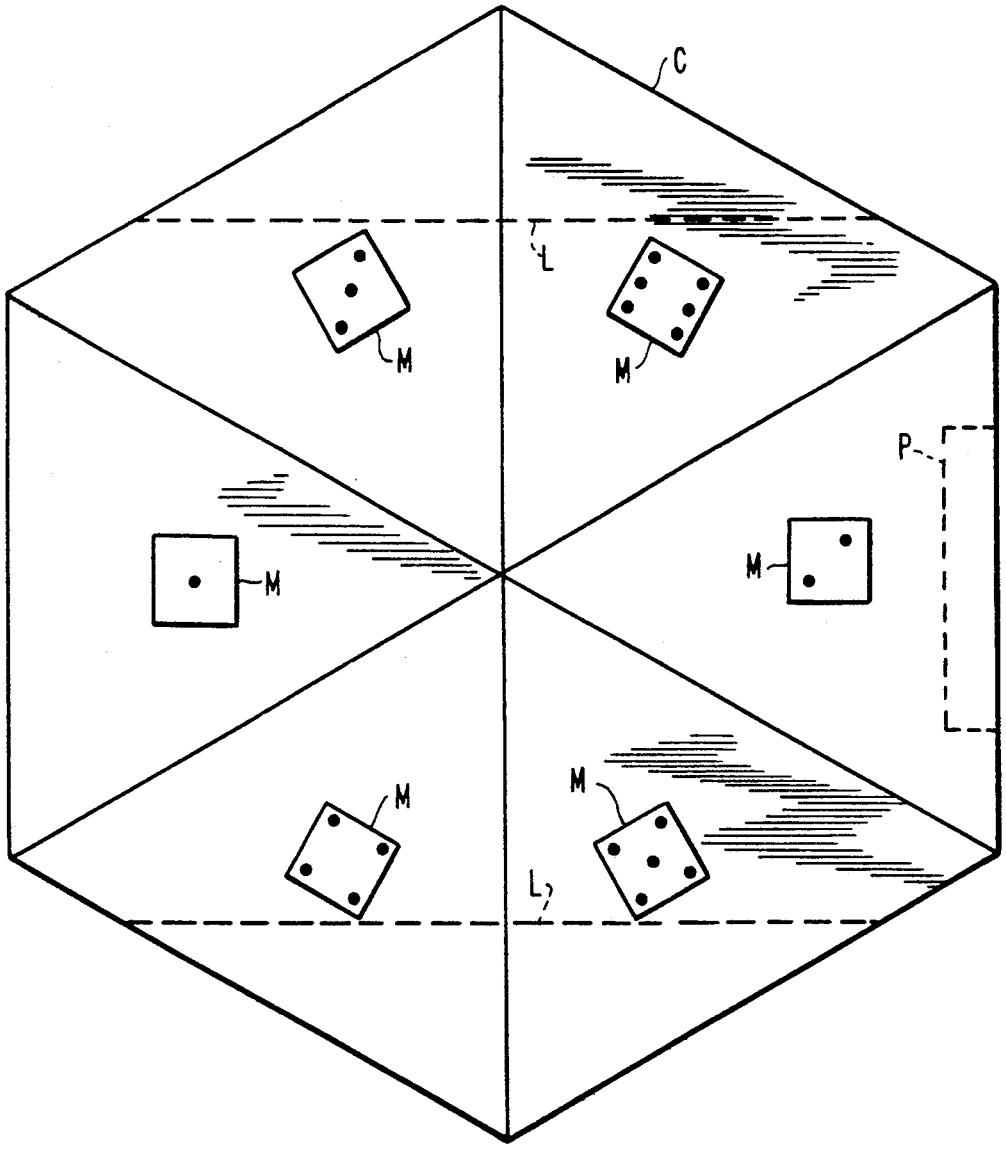
FIG. 1 is a plan view of clue means of the apparatus.
Figure 2:
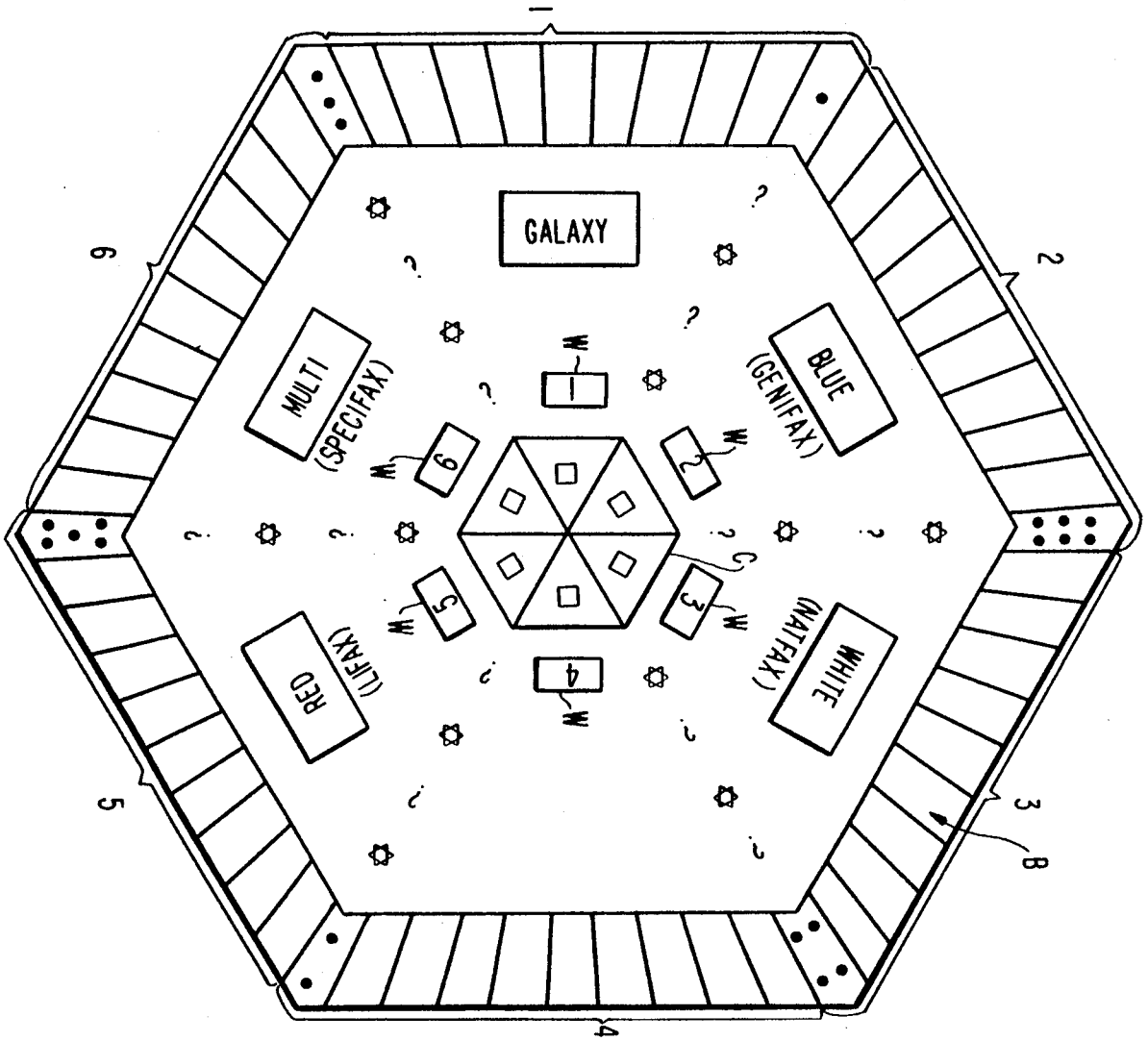
FIG. 2 is a plan view of a board of the apparatus, illustrating the position of the clue means of FIG. 1.
Figure 3:
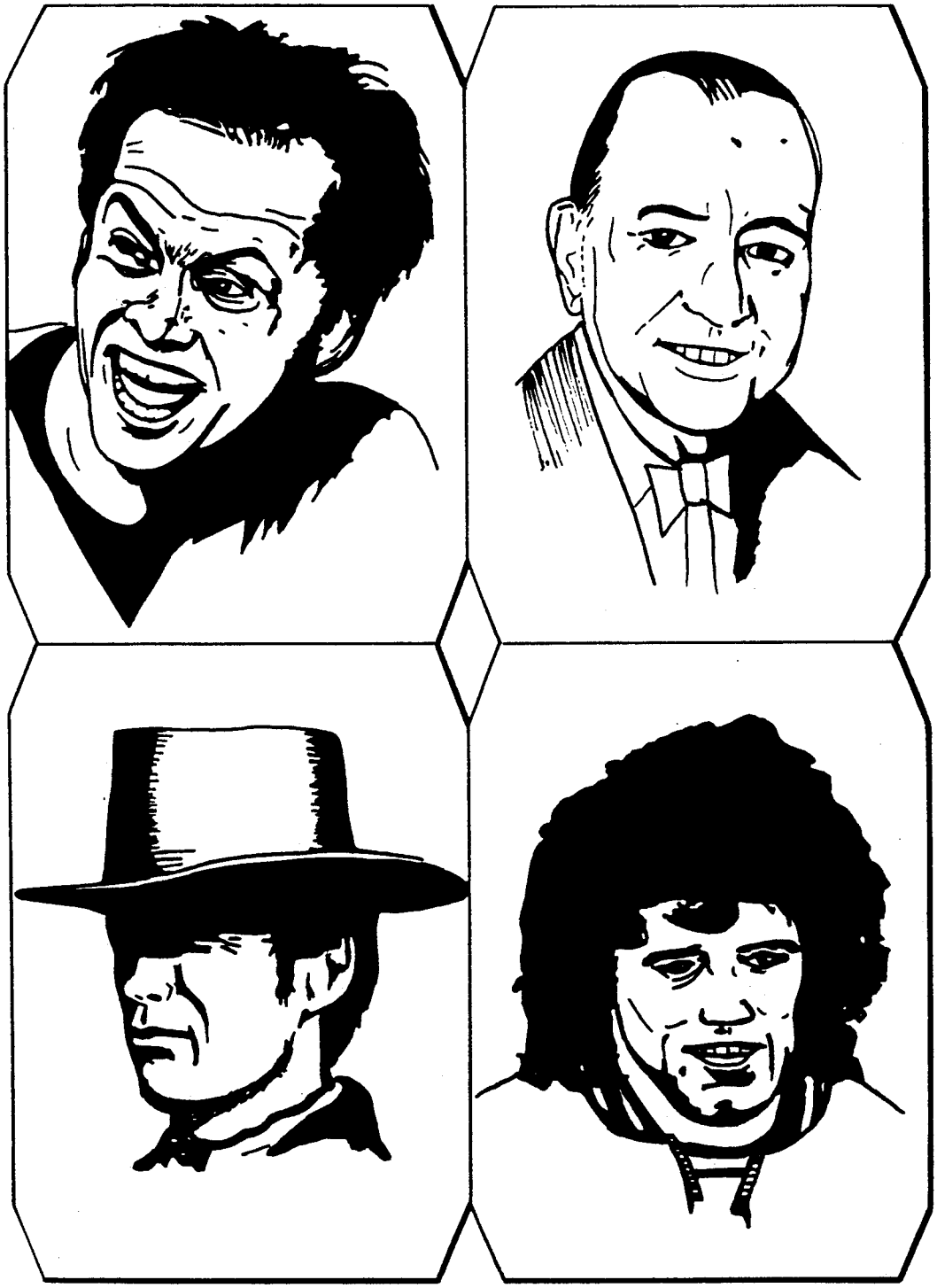
FIG. 3 illustrates a selection of clues.

With reference to the drawings, the illustrative embodiment of apparatus for playing a game, which apparatus is expressly in accordance with the invention, comprises one board B, one die, fifteen red "flids", [i.e. counters] fifteen blue flids, and fifteen white flids, six flubs [playing pieces] each capable of accommodating a plurality of said flids, one "super nova" [i.e. a random question/clue generating device], one "casket" C [i.e. clue means], six "magnetic numbers" for conveniently designating different segments of the casket, twenty four tokens in the form of respective "constellation" cards, three hundred picture cards [each affording a respective clue, and each capable of being incorporated into the casket], five hundred question cards [each carrying six questions], a plurality of information-carrying articles [referred to as "fax cards"] namely thirty two red fax cards, forty two white fax cards, thirty six blue fax cards and ninety nine multi-coloured fax cards. The apparatus further comprises thirty "galaxy cards".

The game is preferably played as a multi-round game, and one of the constellation cards is awarded, selected at random, to whichever player wins a given round.

The above apparatus enables the game to be played by up to six players [or groups.]

The object of each round of the game is to identify a respective mystery personality [or alternatively some other mystery entity such as an object or a place] as segments of the casket are removed to progressively reveal a clue represented by one of the picture cards which has previously been incorporated into the casket for that round.

The fax cards provide miscellaneous items of information, some of which are pertinent to a given mystery entity, and some of which are not, and each player must try to collect up to five fax cards which give a correct insight into the mystery personality. Fax cards have a tariff [points] value which is calculated on the completion of a round [when the personality is formally identified] and where appropriate this is added to any points accrued during the course of the round. The player scoring the most points in a round is awarded a "constellation" card, and the first player who, over a number of rounds, is able to accumulate some predetermined number or selection of constellation cards is deemed to be the overall winner of the game. With regard to the constellation cards, these may conveniently comprise eight of each of three distinct types of cards, and it may be an object of the game to collect at least one constellation card of each type. Thus for example the different types of cards may represent different respective parts of the word "constellation", which, when put together, spell the complete word "constellation". Where a swifter finish of an overall game is desired, the constellation cards could be sub-labelled with names or illustrations of stars/planets, some more easily acquired combination of which may conclude the game.

Alternatively, the constellation cards could be sub-labelled with the names of actual constellations e.g. Orion, Taurus, for example eight constellations in total, three of the cards bearing the name of each such constellation, and it may be an object of the game to accumulate all three cards bearing a particular constellation name. It will be appreciated that this, in general, makes the game take longer.

In order to set the game in motion, each player selects a colour and takes a "flub" [marker ship], each player throws the die, and the player throwing the highest score starts the game. With the players disposed around the board the order of play is clockwise, unless otherwise stated. Each player begins with his "flub" at a position of his own respective colour, and moves the flub in a clocwise direction around the board, by the number of spaces indicated by the die in consequence of a throw.

In the course of the game:

If a player lands on a "throw a number" square position, the player must roll, on the die, the number designated. If successful the player selects the stated number of flids [counters] and rolls the die again. If the player is unsuccessful, the die is passed to the next player.

If a player lands on an "answer question" square, the player must answer the question correctly. If successful, the player selects a flid and continues. If unsuccessful, the player passes the die to the next player.

If a player lands on a position or basic position having the colour of another player, the player that so lands draws a question card and must ask the other player the numbered question on the card designated by the number indicated by the die. If the other player answers correctly, the other player commences his turn. If incorrect, the first player continues with the die. If the colour is not in use, the first player continues with his throw.

If a player lands on a "fax card" square/position, the player must take a fax card of that colour, unless he wishes to use a "galaxy bloca" card [see later] to remove that obligation. If a player lands on a "loose all flids" position, all the player's flids are relinquished before the player continues.

If a player lands on a "star search" position, they should shake the super nova device, resting it then in an upright position on the board so as to display the letter elements so selected at random at "windows" of the device and activating the timer [in this example a sand clock]. If the player is successful [see later] he scores two points and can take either a fax card or a galaxy card. If unsuccessful [see later] the die is passed to the next player.

If a player lands on a gold-coloured square, indicating a particular number, the player must attempt to roll, on the die, the number indicated on the square. If successful, the player may remove the particular segment bearing that number from the casket and so reveal part of the hidden personality's face, and then continue in accordance with the normal meaning of the throw. If unsuccessful, the die is passed to the next player.

Once activated, gold squares necessarily become void, and players landing on them should throw again.

Various terms used in the above "constellation" game will now be explained:

FLIDS: A player attempts to collect flids [counters]. There are three flids colours, red, white and blue. Once a player has collected three flids of the same colour they must be exchanged for a fax card of that colour. Alternatively, three flids, one of each of the different colours, may be exchanged for a "multi-coloured" fax card. If a player has collected seven flids, and the casket is intact at that point, the player may submit said seven flids and remove a casket segment of his choice.

FAX CARDS: These are cards which carry information; they are red, white, blue and multi-coloured. Players attempt to collect five fax cards which will give correct information about the mystery personality. Red fax cards may contain information such as male/female, or dead/alive, white fax cards may contain information on nationality, blue fax cards may carry information on the mystery person's general area of fame, and multi-coloured fax cards may carry information on a specific area of fame. Each fax card has a tariff value, some of them bearing a special symbol which doubles their tariff value.

STAR SEARCH [using the super nova device]: The super nova is placed upright to reveal up to three letters in respective windows, and so as to activate the timer. In order to be successful, a correct answer must be provided within the time limit. The letters displayed are to be used as representing the initials of famous people the colour of the first letter imposing the category of the person [or if a blank is revealed as the first letter, the colour of the second letter will impose the category], the categories being brown=sport, green=entertainment, yellow=fictional character.

Said initials must be used in sequence i.e. B:A:T could be a star with the initials BA: BT: or AT.

If an asterisk is revealed, a letter may be used twice. If three asterisks appear, a player may remove any segment from the casket.

The answer to any "star search" must be agreed as being acceptable by at least one other player. If acceptable, the player scores two points, and may take either a fax card or a galaxy card. If the answer is unacceptable, or is not provided within the time limit, the die is passed to the next player GALAXY CARDS: These may be taken after a successful star search. Amongst the cards are "bloca" fax cards. These can be retained and used

[a] To prevent the "infiltration" of an unwanted fax-card. For example, it may be obvious from the portion of the picture revealed by a certain time that the mystery personality is male, and by surrendering a bloca fax card at that point, the player may nullify an irrelevant female fax card.

[b] To shield an incorrect fax card at the end of the round, when points are added up. The bloca fax should be placed over incorrect fax cards before the formal identification of the personality. If a galaxy card is retained and not used before the completion of a round, a point is deducted for each such galaxy card.

IDENTIFICATION: A player may make an identification of the mystery entity at any time during the respective player's turn. The name of the personality is written down and placed in a respective "bid" wallet, in concealed manner, the first player to attempt identification using a wallet labelled "first bid" the second player to attempt identification using a wallet labelled "second bid" and so on. The round is completed when

[a] all bids have been submitted or

[b] a completion galaxy card is played.

If a bid has not been made by the time that all the segments have been removed, it will count as a "no bid".

SCORING POINTS: When the personality is revealed and their profile uncovered, either when all the segments have been removed or when all bids have been submitted, each player then calculates his respective points tally, arranging his points/cards in ascending points value and totalling the respective points, but stopping at the first fax card which does not correctly relate to the revealed mystery personality.

When arranging the points/cards in ascending points order, only the basic tariff values of fax cards are taken into account but when the points are totalled, the points contribution due to any fax card bearing a special "bonus" symbol is calculated on the basis that is double the basic tariff value of the card concerned.

If the "first bid" player is correct, that player receives ten points. In addition that player should multiply the points tally of his correct fax cards by the number of players, to give a final score for the round.

If the "first" bid player is incorrect, that player must deduct two points for each player [including himself]

from the points tally calculated from his correct fax cards, to give his final score for the round. The second bid is then considered.

If the "second bid" is correct, the second bid player will receive ten points, plus the tally of his correct fax cards multiplied by the number of players less one. If unsuccessful, the player should deduct two points for each player less one.

If the "third bid" is successful, the player will receive ten points, plus the tally of his correct fax cards multiplied by the number of players less two. If unsuccessful two points should be deducted for every player, less two.

All players making a correct identification receive a minimum of five points.

If a player makes "no bid", it must still be submitted, in which case they will receive points from their fax card tally only. "Live bids" will have priority over no bids. A player may make only one bid per round.

The player with the highest point score at the completion of a round takes a constellation card, and as hereinbefore set out, the first player, who over a number of rounds, is able to accumulate a predetermined number or selection of "constellation" cards shall be deemed to be the outright winner of the game as a whole.

The natures, and quantities, of galaxy cards of different types as follows:

| GALAXY CARD: | |
|---|---|
| BLOCA FAX RED | 5 |
| BLOCA FAX WHITE | 3 |
| BLOCA FAX BLUE | 5 |
| STAR SHOWER [every player must make a bid, Mystery entity revealed] | 2 |
| LOSE A RED FAX | 1 |
| LOSE A WHITE FAX | 1 |
| LOSE A BLUE FAX | 1 |
| CONTINUE YOUR TURN: | 2 |
| Remove a FLID from every other player | 2 |
| DESTROY ALL FLIDS IN YELLOW FLUB | 1 |
| DESTROY ALL FLIDS IN BROWN FLUB | 1 |
| DESTROY ALL FLIDS IN GREEN FLUB | 1 |
| DESTROY ALL FLIDS IN BLUE FLUB | 1 |
| DESTROY ALL FLIDS IN WHITE FLUB | 1 |
| DESTROY ALL FLIDS IN RED FLUB | 1 |
| REMOVE ANY SINGLE SEGMENT | 2 |

The natures and quantities, and points tariffs, of the various fax cards are as set out below:

| FAX CARDS | | |
|---|---|---|
| DESIGNATION | NO | TARIFF |
| RED: | | |
| Male | 8 | 1 point |
| Female | 8 | 1 point |
| Alive | 8 | 2 points |
| Dead | 8 | 3 points |
| WHITE: | | |
| European | 6 | 6 points |
| N. America | 6 | 5 points |
| S. American | 6 | 7 points |
| African | 6 | 5 points |
| Asian | 6 | 6 points |
| Australian | 6 | 7 points |
| British | 6 | 5 points |
| BLUE: | | |
| Pop Music | 6 | 8 points |
| Movies | 6 | 8 points |
| T.V. | 6 | 8 points |
| Arts | 6 | 9 points |

-continued

| FAX CARDS | | |
|---|---|---|
| DESIGNATION | NO | TARIFF |
| Public Life | 6 | 8 points |
| Sport | 6 | 8 points |
| MULTI-COLOURED FAX: | | |
| General/Pop - Tariffs | | |
| Solo Instrumentalist | 3 | 12 |
| Solo Vocalist | 3 | 10 |
| Group Vocalist | 3 | 10 |
| Group Instrumentalist | 3 | 12 |
| Disc Jockey | 3 | 12 |
| General Movies | | |
| Western | 3 | 10 |
| Dramatic | 3 | 11 |
| Director | 3 | 12 |
| Adventure/Thriller | 3 | 10 |
| Comedy | 3 | 10 |
| General Sport | | |
| Soccer | 3 | 10 |
| Snooker | 3 | 10 |
| Golf | 3 | 11 |
| Tennis | 3 | 11 |
| Athletics | 3 | 12 |
| Boxing | 3 | 11 |
| Cricket | 3 | 11 |
| General T.V. | | |
| News/Commentator | 3 | 12 |
| T.V. Variety | 3 | 11 |
| Situation Comedy | 3 | 10 |
| Crime Series | 3 | 10 |
| Soap Series | 3 | 12 |
| Quiz Show/Chat Show Host | 3 | 11 |
| General Public Life | | |
| Royalty | 3 | 10 |
| P.M./President | 3 | 11 |
| Dictator/Military | 3 | 12 |
| Religious Figure | 3 | 11 |
| General Arts | | |
| Opera/Ballet | 3 | 14 |
| Artist | 3 | 12 |
| Novelist/Poet | 3 | 12 |
| Theatre (inc. playwright) | 3 | 11 |
| Classical Musician (inc. composers) | 3 | 12 |

The "super nova" comprises twenty six characters, namely twenty two letters, three asterisks and one blank, with the timer mounted on its side.

In relation to the casket, the mask segments are afforded by respective triangular metal elements arranged in hexagonal array, and hinged at their outer edges so that they may be "removed" by flipping them back about the hinges, magnetic numbers M being attached [interchangeably] to the respective segments for identification purposes. The area occupied by the illustration of the mystery personality is indicated by dotted lines L in FIG. 1, and additionally a further plate P lying beneath one of the segments conceals a name panel on the illustration.

It will be appreciated that the flubs are substantially boat-shaped, enabling them to accommodate the pawn-like flids.

The "bid wallets" are generally positioned on the board at the locations W indicated, before and after bids are made.

The features disclosed in the foregoing description, or the following claims, or the accompanying drawings, expressed in their specific forms or in the terms of a means for performing the disclosed function, or a method or process for attaining the disclosed result, or a class or group of substances or compositions, as appropriate, may, separately or in any combination of such features, be utilised for realising the invention in diverse forms thereof.

I claim:

1. Apparatus for playing a mystery entity identification game, the apparatus comprising a plurality of clue providing means relating to a plurality of mystery entities, each of the clue providing means providing a clue as to a specific mystery entity to which that particular clue providing means relates, initial selection of such clue providing means being effective to determine the mystery entity to be identified, said apparatus being adapted to permit the clue provided by that clue providing means to be progressively revealed in the course of the game, and a selection of information carrying articles to be collected by players in the course of the game for later comparison with the predetermined mystery entity when the latter has been identified, each such article specifying one of a number of possible characteristics which individual such mystery entities have.

2. Apparatus according to claim 1 wherein, in relation to any particular one of the mystery entities, only a respective sub-set of the information carrying articles carry information which correctly relates to that particular mystery entity.

3. Apparatus according to claim 1 which comprises a plurality of distinct sets of such information carrying articles, each set dealing with a respective variety of characteristics lying under a respective heading.

4. Apparatus according to claim 1 wherein each such clue is in the form of an illustration or picture of the respective mystery entity.

5. Apparatus according to claim 4 wherein each such mystery entity is a person, an object or a place.

6. Apparatus according to claim 1 further comprising a plurality of tokens to be collected in the course of the game.

7. Apparatus according to claim 6 wherein said tokens are afforded by a plurality of sets of tokens of different types.

8. Apparatus according to claim 1 further comprising random outcome means, a board and a plurality of playing pieces to be moved from position to position on the board in the course of the game.

9. Apparatus according to claim 1 comprising counters to be awarded to players in the course of the game.

10. Apparatus according to claim 1 comprising means to provide a randomly generated clue or question, said means comprising a device wherein the clue or question is provided by a number of clue-providing elements adapted to move at random to positions at which they dictate the question or clue.

11. Apparatus according to claim 10 wherein said means comprises built-in timing means.

12. Apparatus according to claim 1 comprising means by which players submit concealed answers.

* * * * *